United States Patent [19]

Iida et al.

[11] Patent Number: 4,972,121

[45] Date of Patent: Nov. 20, 1990

[54] METAL VAPOR DISCHARGE LAMP

[75] Inventors: Takenobu Iida, Urawa; Jojiro Shiina, Gyoda; Minoru Yasukawa, Kohnosu, all of Japan

[73] Assignee: Iwasaki Electric Co., Ltd., Tokyo, Japan

[21] Appl. No.: 353,434

[22] Filed: May 18, 1989

[30] Foreign Application Priority Data

May 23, 1988 [JP] Japan ..... 63-123852

[51] Int. Cl.[5] ..... H05B 41/00

[52] U.S. Cl. ..... 315/58; 315/73; 315/240

[58] Field of Search ..... 315/56, 58, 59, 73, 315/240

[56] References Cited

U.S. PATENT DOCUMENTS 4,897,576 1/1990 Iida et al. ..... 315/73

*Primary Examiner*—Robert J. Pascal

[57] ABSTRACT

A metal vapor discharge lamp of the type comprising a translucent outer bulb that houses an arc tube and a starter which is connected in parallel to the arc tube and which includes a nonlinear capacitor, at least one of the lead wires of the nonlinear capacitor being connected to a support line whose thickness is such that it does not obstruct the oscillation due to any electrostriction of the nonlinear capacitor and such that it fuses whenever a large current flows through the nonlinear capacitor. Due to this construction, the oscillation of the nonlinear capacitor is not obstructed, so that a high-voltage pulse can be generated and the noise level lowered. Furthermore, since the support line is designed to be fused by a large electric current, thus breaking the electric circuit, any burning of the ballast can be prevented.

3 Claims, 2 Drawing Sheets

METAL VAPOR DISCHARGE LAMP

BACKGROUND OF THE INVENTION

This invention relates to an improvement in a metal vapor discharge lamp of the type comprising an arc tube, a starter connected in parallel thereto, and a translucent outer bulb housing them, for example, in a high-pressure sodium lamp having a starter therein.

FIG. 1 shows the equivalent circuit configuration of a conventional high-pressure sodium lamp having a starter therein along with an example of the lighting circuit thereof. The construction of this high-pressure sodium lamp is such that a translucent outer bulb 4 houses an arc tube 1 and a serial circuit which is connected in parallel thereto and which consists of a nonlinear capacitor 2 and a bimetal switch 3. This lamp is connected through a ballast 5 consisting of an inductor to an alternating current power source 6, the lamp being lit by applying an alternating voltage thereto. The nonlinear capacitor 2 then acts as a switching element in accordance with its voltage-charge hysteresis characteristic, rapidly interrupting the current flowing through the ballast 5. This causes a high-voltage pulse to be generated on either end of the ballast 5. The pulse is applied to the arc tube 1 along with the power source voltage, thereby lighting the lamp. After the lamp has come on, the bimetal switch 3 is opened by the heat from the arc tube 1, thereby stopping the operation of the starter.

The nonlinear capacitor adopted in a lamp of the type described above, is described in detail, for example, in Japanese Patent Publication No. 62-60803. FIGS. 2A and 2B show schematically the construction thereof. The capacitor shown comprises a dielectric substrate 7 which is principally made of barium titanate or the like. Provided on both sides of the dielectric substrate 7 are electrode films 8*a* and 8*b* to which lead wires 9*a* and 9*b* are electrically connected, respectively. The heat resistant material with which the electrode films 8*a* and 8*b* are covered and the details regarding the joint structure between the electrode films 8*a*, 8*b* and the lead wires 9*a*, 9*b* are omitted in the drawings.

When incorporating the nonlinear capacitor 2 having the above-described construction into a lamp, the lead wires 9*a* and 9*b* of the nonlinear capacitor 2 are often connected and fixed by means of welding or the like to support lines 10*a* and 10*b* of different polarities which are connected to conductive arc tube supports or the like, as shown in FIG. 3.

However, it has been found that lamps having the above-described construction involve the following problems in service:

(1) When an alternating electric field is applied to a nonlinear capacitor, inversion occurs in the spontaneous polarization thereof, so that the crystals constituting the dielectric substrate are elongated in the direction in which the electric field is applied, and are contracted in the direction perpendicular to the electric field, a phenomenon called electrostriction. As a result, a voltage-charge hysteresis characteristic is obtained.

However, if the lead wires 9*a* and 9*b* of the nonlinear capacitor 2 are firmly connected to the conductive supports 10*a* and 10*b* as shown in FIG. 3, the oscillation due to the electrostriction of the dielectric substrate 7 of the nonlinear capacitor 2 is restrained to a considerable degree, so that a satisfactory voltage-charge hysteresis characteristic cannot be obtained. As a result, the voltage pulse generated is inevitably rather low.

Moreover, it has been found that the oscillation due to the electrostriction of the dielectric substrate 7 involves a noise of a considerable magnitude since it is transmitted to other sections as the oscillation of the lead wires 9*a*, 9*b* and the conductive supports 10*a*, 10*b*.

(2) If the operation is continued while restraining the oscillation due to the electrostriction of the dielectric substrate 7 to a considerable extent as described above, an internal stress will act within the dielectric substrate 7 to generate cracks along the grain boundaries, thereby damaging the substrate. In some cases, discharge may occur between the electrodes of the nonlinear capacitor when the dielectric substrate suffers damage, which can cause a large electric current to flow through the starter, thereby burning the winding of the ballast 5.

(3) Discharge may occur between the electrodes of the nonlinear capacitor if near the end of the lamp service life the rare gas in the arc tube leaks into the outer bulb that houses the nonlinear capacitor, which will generate an atmosphere in the outer bulb that allows discharge to occur easily. As a result, a large current may flow through the starter, which also leads to burning of the ballast winding.

SUMMARY OF THE INVENTION

It is an object of this invention to provide a metal vapor discharge lamp in which the above mentioned problems are eliminated.

Another object of this invention is to provide a metal vapor discharge lamp which can generate a high-pulse voltage so that it can be lighted with ease.

Still another object of this invention is to provide a metal vapor discharge lamp which can prevent any burning of the ballast.

In order to attain the above objects, this invention provides a metal vapor discharge lamp of the type comprising a translucent outer bulb that houses an arc tube and a starter which is connected in parallel to the arc tube and which includes a nonlinear capacitor, the above-mentioned nonlinear capacitor having on both sides thereof electrode films to which respective lead wires are electrically connected, at least one of the above-mentioned lead wires being connected to a support line whose thickness is such that it does not obstruct the oscillation due to any electrostriction of the above-mentioned dielectric substrate and such that it fuses whenever a large current flows through the nonlinear capacitor.

Thanks to this construction, any oscillation due to electrostriction of the dielectric substrate of the nonlinear capacitor remains unobstructed, so that a satisfactory voltage-charge hysteresis can be obtained, thus providing a metal vapor discharge lamp which generates a high voltage pulse and which can be lit with stability. Furthermore, the noise due to the above-mentioned oscillation is absorbed by the support line mentioned above, thereby making it possible to lower the noise level.

In addition, since the support line employed does not obstruct the oscillation of the dielectric substrate, any destruction of the dielectric substrate due to cracks generated along the grain boundaries during oscillation of the dielectric substrate, can be prevented. Moreover, if discharge occurs between the electrodes of the nonlinear capacitor and a large current is allowed to flow through the starter, the above-mentioned support line fuses to break the electric current circuit, thereby preventing any burning accident in the ballast, etc.

DETAILED DESCRIPTION OF THE PREFERRED EMBODIMENTS

Figure 4:
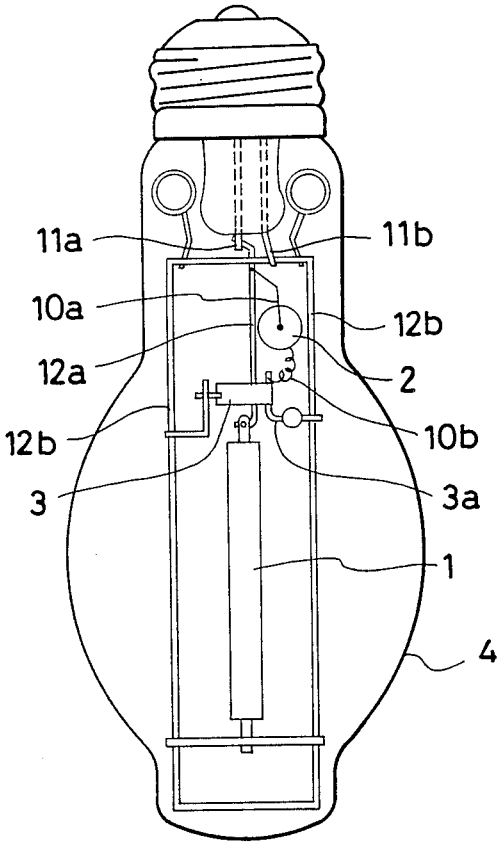
FIG. 4 is a view showing an embodiment of a metal vapor discharge lamp in accordance with this invention.
Figure 5:
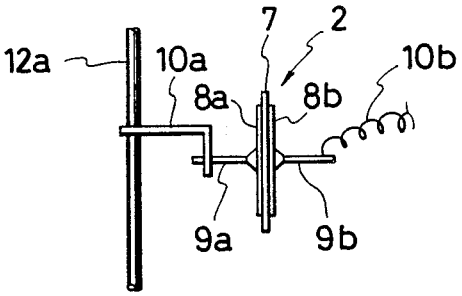
FIG. 5 is a view showing, in an enlarged state, the support section of the nonlinear capacitor in the discharge lamp shown in FIG. 4.

FIG. 4 shows an example of a high-pressure sodium lamp having a starter therein which constitutes an embodiment of this invention. FIG. 5 shows, in an enlarged state, the support section of the nonlinear capacitor used in this high-pressure sodium lamp. In FIG. 4, the reference numeral 1 indicates an arc tube comprising a ceramic tube having electrodes sealed to its ends and containing sodium, mercury and a rare gas which are sealed therein. This arc tube 1 is supported by conductive supports 11*a* and 11*b* which also serve as conductors for supplying electricity to the electrodes and by other conductive supports 12*a* and 12*b* which are fixed thereto, etc.

Figure 2A:
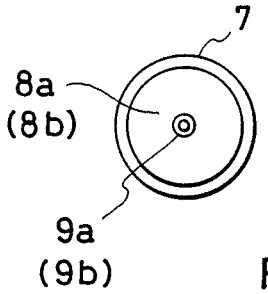
FIG. 2A PRIOR ART
FIGS. 2A and 2B are a front view and a side view, respectively, of a non-linear capacitor used in the above discharge lamp.
Figure 2B:
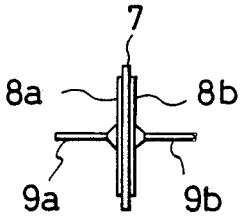
FIG. 2B PRIOR ART
Figure 3:
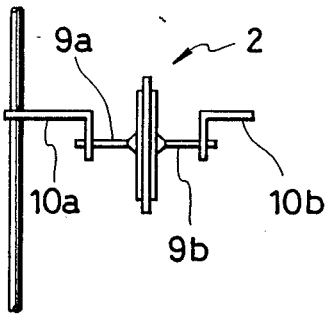
FIG. 3 PRIOR ART
FIG. 3 is side view showing, in an enlarged state, the support section of the above nonlinear capacitor.

The reference numeral 2 indicates a nonlinear capacitor which has a similar construction to that shown in FIGS. 2A and 2B. As shown in FIG. 5, one end of one lead wire 9*a* of this nonlinear capacitor 2 is mounted on a support line 10*a* which is fixed to the conductive support 12*a*. One end of the other lead wire 9*b* of the nonlinear capacitor 2 is connected through a support line 10*b* to a conductive support 3*a* of a bimetal switch 3. This conductive support 3*a* of the bimetal switch 3 is supported, in an insulated state, by the above-mentioned conductive support 12*b*. Accordingly, the lead wire 9*b* of the nonlinear capacitor 2 is electrically connected to the conductive support 12*b* through the bimetal switch 3.

At least one of the above-mentioned support lines 10*a* and 10*b* (10*b* in this embodiment) has such a thickness that it does not obstruct the oscillation due to the electrostriction of the dielectric substrate 7 of the nonlinear capacitor 2 and that it fuses when a large current flows through the nonlinear capacitor 2. Specifically, a fusion-resistant metal wire having a diameter of 0.04 to 0.4 mm is employed, such as a wire of molybdenum, tungsten, tantalum, niobium, an iron/nickel alloy, nickel, iron, etc. An appropriate wire length may be about 10 mm. Although a solid wire may suffice, a wire wound in a coil-like manner will be more suitable.

The thickness and length of the support line 10*b* must be selected taking into consideration the magnetic of the short-circuit current which flows through the ballast 5 when discharge occurs between the electrodes of the nonlinear capacitor, the material of the support line, the mechanical strength thereof, etc. The results of experiments conducted on lamps of different capacitances including one of the 100W-class and one of the 1KW-class showed that a suitable diameter of the support line is, as stated above, in the range of 0.04 to 0.4 mm and that a suitable length when the diameter is 0.4 mm is about 10 mm. If the diameter of the support line is less than 0.04 mm, the line will be more liable to be broken by the spot welding used in assembling the lamp, or by the oscillation, etc., while it is in service after the assembly of the lamp. A support line diameter of more than 0.4 mm will result in the support line not being broken eve by the large current accompanying a discharge between the nonlinear capacitor, so that the ballast, etc. will be subject to burning.

Figure 1:
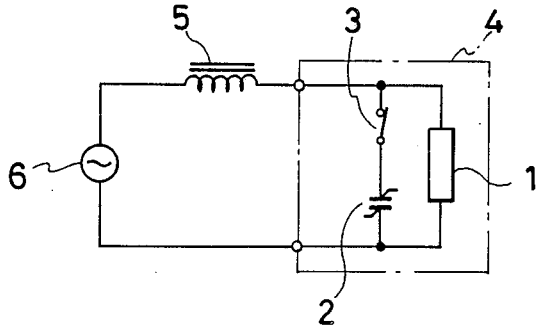
FIG. 1 PRIOR ART
FIG. 1 is a circuit diagram showing the equivalent circuit configuration of a conventional high-pressure sodium lamp having a starter therein along with the lighting circuit thereof.

As for the equivalent circuit in the lamp of the embodiment shown in FIG. 4 and the lighting circuit thereof, they have similar constructions to those shown in FIG. 1.

While in the above embodiment the starter consists of a combination of a nonlinear capacitor and a bimetal switch, this invention can be applied to any type of metal vapor discharge lamp as long as its starter includes a nonlinear capacitor.

As will be apparent from the foregoing description, in accordance with this invention, at least one of the lead wires of the nonlinear capacitor constituting the starter is connected to a support line which has such a thickness that it will not obstruct the oscillation due to the electrostriction of the dielectric substrate of the above-mentioned nonlinear capacitor. Accordingly, the oscillation due to the electrostriction of the dielectric substrate is not restrained, so that a high-voltage pulse can be generated. Furthermore, since the oscillation of the dielectric substrate is absorbed by the support line, no noise is generated. In addition, since the thickness of the above-mentioned support line is selected so that it will fuse whenever a large current flows through the nonlinear capacitor, the support line serves as a fuse to break the electric circuit when a large current is allowed to flow, thereby effectively preventing any burning of the ballast.

What is claimed is:

1. In a metal vapor discharge lamp of the type comprising a translucent outer bulb that houses an arc tube and a starter which is connected in parallel to the arc tube and which includes a nonlinear capacitor, the improvement comprising the fact that said nonlinear capacitor has on both sides of a dielectric substrate thereof electrode films to which respective lead wires are electrically connected, and such that at least one of the lead wires of said nonlinear capacitor is connected to a support line whose thickness is such that it does not obstruct the oscillation due to any electrostriction of the dielectric substrate of said nonlinear capacitor and such that it fuses whenever a large current flows through the nonlinear capacitor.

2. A metal vapor discharge lamp as claimed in claim 1, wherein said support line consists of a fusion-resistant metal having a diameter of 0.04 to 0.4 mm.

3. A metal vapor discharge lamp as claimed in claim 1, wherein said support line consists of a fusion-resistant metal having a diameter of 0.04 to 0.4 mm which is wound in a coil-like manner.

* * * * *